United States Patent [19]

Davis

[11] Patent Number: 5,025,704

[45] Date of Patent: Jun. 25, 1991

[54] CORDLESS GUITAR TRANSMITTER

[75] Inventor: Richard L. Davis, Kentville, Canada

[73] Assignee: Airjack Wireless Systems Incorporated, Dartmouth, Canada

[21] Appl. No.: 337,907

[22] Filed: Apr. 14, 1989

[51] Int. Cl.[5] ..... G10H 3/00; H05B 1/034

[52] U.S. Cl. ..... 84/723; 361/395; 455/95

[58] Field of Search ..... 84/1, 696, 723, 725, 84/726, 726; 455/95, 129, 113; 439/668, 669; 361/395; 307/150

[56] References Cited

U.S. PATENT DOCUMENTS

| | | | |
|---|---|---|---|
| 2,236,946 | 4/1941 | Knopp | 84/726 |
| 2,840,694 | 6/1958 | Morgan | 455/97 |
| 3,080,785 | 3/1963 | Evans | 84/731 |
| 3,085,460 | 4/1963 | Edwards | 84/1 |
| 3,087,117 | 4/1963 | Mitchell | 455/95 |
| 3,296,916 | 1/1967 | Palmer | 84/1 |
| 3,579,211 | 5/1971 | Ashley et al. | 455/95 |
| 3,743,751 | 7/1973 | Ibanez | 84/741 |
| 3,781,451 | 12/1973 | Nolan | 84/723 |
| 3,825,666 | 7/1974 | Jaggers | 84/672 |
| 3,901,118 | 8/1975 | Ford | 84/723 |
| 4,004,228 | 1/1977 | Mullett | 455/95 |
| 4,335,930 | 6/1982 | Feldman | 439/669 |
| 4,344,184 | 8/1982 | Edwards | 455/95 |
| 4,430,757 | 2/1984 | Szakvary | 455/100 |
| 4,453,269 | 6/1984 | Skar | 455/129 |
| 4,647,135 | 3/1987 | Reinhardt | 439/669 |
| 4,721,926 | 1/1988 | Aota | 455/113 |
| 4,794,622 | 12/1988 | Isaacman et al. | 455/119 |

*Primary Examiner*—Geoffrey S. Evans
*Attorney, Agent, or Firm*—Robert M. Phipps

[57] ABSTRACT

An electronic device which, when connected to an electric guitar, or other similar stringed instrument, will effect wireless transmission over a selectable frequency of the FM broadcast band. The unit is compact as it uses the metal strings of the guitar as a partial antenna. The unit remains stationary after being plugged into the guitar's input receptacle, and no transmitting portion of the device has to be attached to the musician's belt or guitar strap, or to the musician's person in any fashion. Furthermore, no large unsightly, cumbersome antenna extends from the device intself. The device is automatically turned on when plugged in.

20 Claims, 2 Drawing Sheets

CORDLESS GUITAR TRANSMITTER

BACKGROUND OF THE INVENTION

Electric guitars in common use must be connected into special amplifiers by wire. As such amplifiers usually require household AC current, they cannOt be readily taken to places where AC current is not available such as beaches, parks or roadside rest stops, for example. Even if a guitar amplifier could operate by battery power, it would be inconvenient to carry it to a beach or park as well as a portable radio (a radio is standard equipment for beach-goers). A guitar adapted to transmit over FM would reduce the need to carry special guitar amplifiers portable FM radios are generally more convenient to transport than guitar amps, and are, in many cases, installed in automobiles. Although some prior art guitars have built-in amplifiers and speakers, such as the guitar of U.S. Pat. No. 3,781,451, these are special devices as opposed to an add-on component which can be used with a favorite old guitar.

While the prior art provides cordless electrical guitar systems, there are problems associated with these designs which the present invention overcomes. For example, prior art devices such as those described in U.S. Pat. Nos. 3,080,785; 3,085,460; 3,296,916; 3,743,751; 3,825,666 and 3,901,118 require a wire or inconveniently long antenna be attached either to the guitar or to the musician to act as an antenna for the transmitter. Instability is often a problem in these devices as the antenna, which is subjected to constant movement while in use, can be affected by external elements such as the musician's body, or other nearby objects of a conductive nature. Further, these external antennae are unsightly and can restrict or impede the musician's choreographic performance.

Another disadvantage of prior art wireless transmitter systems for guitars is that they usually require modification to a guitar, i.e. either the entire system, or a portion thereof must be screwed or taped onto the guitar, for example, generally becoming a rather permanent component of the guitar.

Some prior art wireless transmitter systems for guitars require a special receiver which must, itself, be plugged into a standard guitar amplifier. This, of course, does not solve the problem of the guitarist who wants to amplify his music at a park or beach where AC is not available.

SUMMARY OF THE INVENTION

Accordingly, a transmitter unit for use with a stringed musical instrument having a transducer electrically connected to an output jack is provided, said unit comprising transmitter circuitry; a coil of wire or other conductive means connected to said circuitry and adapted to induce a RF pattern with the strings of said musical instrument, the combination of said coil or other conductive means and said strings acting as an antenna when the unit is in use; a phono plug adapted to be inserted into said output jack, to provide an input to said circuitry from said transducer and to connect said strings to a ground of said circuitry, said plug extending from said housing, said housing being adapted to be held in place on said instrument by said plug; power supply means for providing power to said circuitry.

DESCRIPTION OF THE PREFERRED EMBODIMENT

The preferred embodiment of the present invention is designed to allow musicians to play an electric guitar or other stringed instrument having a transducer and an output jack, and have it received by any nearby FM radio or FM stereo receiver, without any electrical cord being required to connect the guitar to the radio or receiver. A wireless system is provided that is fully tunable over the entire FM broadcast band.

The device is a compact transmitter which does not incorporate or require any cumbersome external antenna.

The device of the preferred embodiment is also a structurally self-supporting transmitter which is readily detachable from and easily attachable to any standard unmodified electric guitar or other similar stringed instrument having a transducer electrically connected to an output jack.

Figure 1:
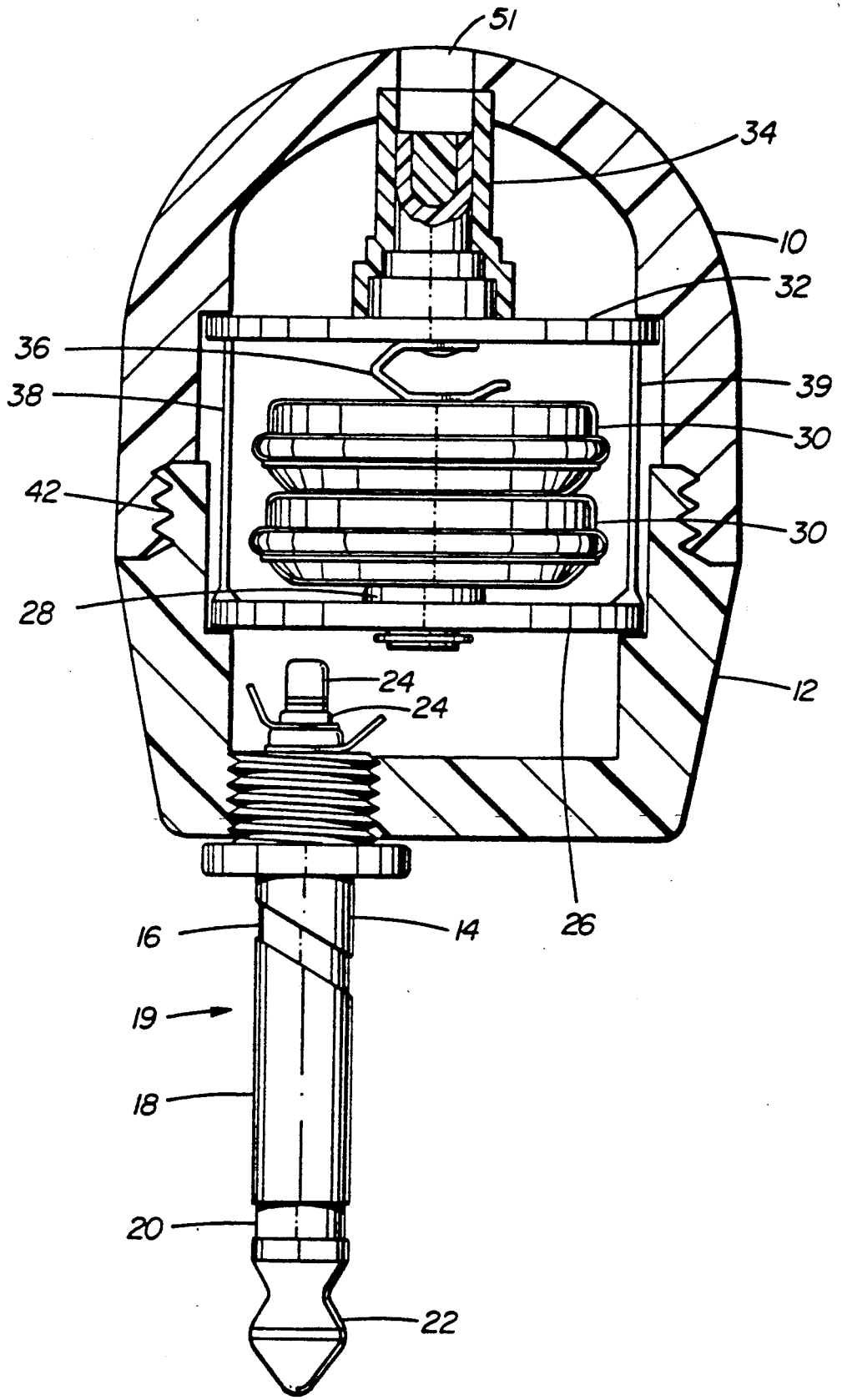
FIG. 1 is a cross sectional view of a preferred embodiment of the cordless guitar transmitter device.

Referring to FIG. 1, the physical layout of the preferred embodiment can be seen.

The complete unit is very compact, being about the size of an egg, and remains generally stationary on the guitar, when inserted, as it plugs directly into the electric guitar's input receptacle. It is therefore not necessary to have the transmitting portion of the device attached to the musician's belt or guitar strap; or to have it attached to the musician's person in any fashion.

The power switch means for the unit is somewhat unique in that it has been incorporated in the modified ¼" phono plug 19. The plug 19 comprises an upper base portion 14, a first insulating spacer 16, a lower base portion 18, a second insulating spacer 20, and a lower plug segment 22. When the plug 19 is inserted into the guitar's input receptacle, the batteries 30 are electrically connected to the circuitry 32, which is then energized as will later be explained in more detail. Removal of the unit from the guitar will effectively turn off the power to the circuit 32 for increased battery life.

The threads 42 of the device allow for the removal of the non-conductive upper casing 10, for easy replacement of batteries 30 which are of the small coin lithium type. Upper circuit board 32 and associated components are physically attached to non-conductive upper casing 10. Plug 19 and associated components are physically attached to non-conductive lower casing 12. When the upper casing 10 is screwed onto lower casing 12, via threads 42, electrical connection is made between upper circuit board 32 and plug 19 and associated components by way of two small spring connector pins 38 and 39.

Modification of the ¼" phono plug 19 for use as a switch has been accomplished by splitting the base portion of plug 19 into two separate portions 14 and 18, and electrically separating them by an insulating spacer 16. The spacer 16 is constructed of a non-conductive material such as plastic. Upper base portion 14 is electrically connected to the negative terminal of batteries 30 placed in series, while the lower base portion 18 is connected to one of the small spring connector pins 38. The other spring connector pin 39 is connected to lower plug segment 22, which allows the pick-up of the guitar to be connected to the circuit, thus providing audio input to the device. These connections to plug segments are made via internal plug connectors 24. The plug base portions 14 and 18 have been separated by first insulating spacer 16 at an angle, as seen in FIG. 1, so that the unit will work effectively in different types of guitars, some of which have input receptacles differing from standard depth, to provide proper connection of the two segments when the device is in use.

The positive terminal of batteries 30 placed in series is connected to the unit's circuitry via upper battery connector 36. The batteries 30 are insulated from spring connector pins 38 and 39 by way of a plastic sleeve (not shown) which can be attached to the upper surface of lower circuit board 26, or to the lower surface of upper circuit board 32.

The transmitting frequency of the device can be adjusted to any frequency in the FM broadcast band (88 to 108 MHz) by adjusting a small ferrite core in tuning inductor 34, which forms a part of the circuit of upper circuit board 32, via tuning aperture 30 located at the top of upper casing 10.

Most electronic components of the transmitter are surface mounted on the upper surface of upper circuit board 32. A small input capacitor $C_1$ (see FIG. 2) is located interior to lower casing 12 (FIG. 1). Referring to FIG. 1, when the unit is manufactured areas surrounding internal plug connectors 24 and tuning inductor 34 are filled with a non-conductive resinous material for stability and durability.

Figure 2:
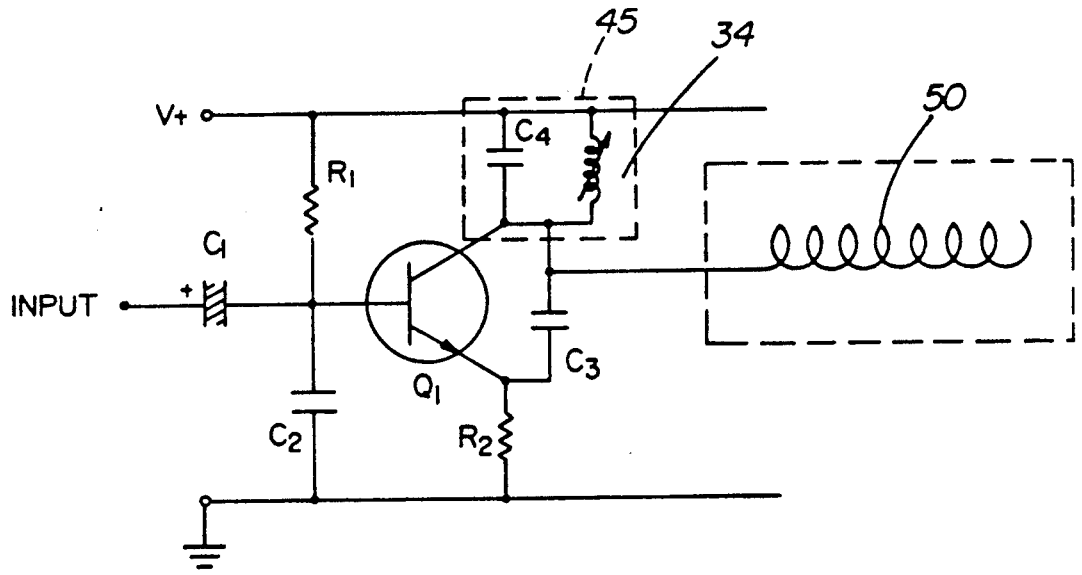
FIG. 2 is an electrical schematic diagram of the circuit of the transmitter device shown in FIG. 1.

Referring now to FIG. 2, a circuit diagram of the transmitter can be seen. The electronic circuit of the unit is based on a modified version of a Colpitts oscillator.

By including a length of wire 50 in the circuit, separate from, but electrically connected to the tank circuit 45, and wrapping it around the components of the upper circuit board 32 (see FIG. 1), R.F. radiation can be induced between the strings of the guitar and the length of wire 50, when the device is in use. There is no movement of the coiled length of wire 50 as its position is fixed in the unit's housing, resulting in excellent frequency stability. As the strings of the guitar are normally connected to ground, they act as a ground plane, or an element of the device's antenna to greatly increase the effective range of the unit when it is in use. No external antenna is required, resulting in compactness of the unit. The resultant transmitting range of the device is very high, in the order of 100 feet, and the signal is remarkably strong and stable. As there are no movable cords, wires or external antennas emanating from the device or attaching it to the guitar, the effective antenna remains stationary relative to the guitar for stability of signal, which could be affected by movement or changes in static capacitance or inductance between a movable cord, wire or external antenna and a musician, if a cord, wire or external antenna were used.

the circuitry does not require any audio preamplification stages as the change in current produced by the change of impedance of the guitar's own transducer adequately modulates, by impedance, the basic RF carrier of the oscillator.

The upper and lower casings 10 and 12 of the unit, as shown in FIG. 1, are produced from plastic or any appropriate material. It is in this housing that all components of the circuit, circuit boards 26 and 32, batteries 30 and connectors 24, 28, 36, 38, 39 and wire coil 50 (see FIG. 2) which acts in co-relation with the guitar strings are contained. The only part external to the casings is the modified ¼" phono jack 19 (see FIG. 1) which emanates from the base of the lower casing 12 and which plugs directly into the guitar when the unit is to be used.

Referring to FIG. 1, an appropriate voltage for series batteries 30 would be 6 volts DC.

Referring to FIG. 2, appropriate values for $R_1$ and $R_2$ would be 47 K ohms and 470 ohms, respectively; these values have been determined to be of an appropriate ratio to properly bias the particular transistor used, and to allow low power consumption. Appropriate values for $C_2$, $C_3$ and $C_4$ would be 0.001 Mfd, 4.7 pf, and 4.7 pf, respectively; an appropriate value of filter capacitor $C_1$ would be found in the range of 1 to 10 Mfd; an appropriate tuning inductor 34 would be adjustable to 10 mH; and an appropriate transistor $Q_1$ would be a Sylvania type ECG 107, npn Si VHF, IF, RF, Amp, OFC transistor.

Several possible modifications of the preferred embodiment will be apparent to those skilled in the art. For example, the values of resistors $R_1$ and $R_2$ could be varied, and the transistor used could be changed, as long as the resistor values are chosen to properly bias the particular transistor used. The values of $C_3$ and $C_4$ being tunable over only part of the FM band. A Hartley oscillator could be substituted for the Colpitts oscillator, in fact any appropriate RF oscillator could be used. Further, the coiled length of wire 50 (see FIG. 2) could be replaced with a metallic coating of the interior or exterior of the upper or lower casing 10 or 12. Although stability is maintained when such a coating is used, range is significantly reduced.

While the preferred embodiment has been disclosed with certain given parameters, obvious modifications to the circuit or to the given parameters will become apparent to those skilled in the art, and the protection sought should be limited only the spirit and scope of the appended claims.

The embodiments of the invention in which an exclusive property or privilege is claimed are defined as follows:

1. A transmitter unit for use with a stringed musical instrument having a transducer electrically connected to an output jack said unit comprising a housing containing transmitter circuitry;

a coil of wire or other conductive means connected to said circuitry and adapted to induce a RF pattern within the strings of said stringed musical instrument, the combination of the said coil or said other conductive means and said strings acting as an antenna when the unit is in use;

a phono plug projecting from said housing for insertion into said output jack, to provide an electrical input to said circuitry from said transducer and to connect said strings to a ground for said circuitry, said housing being adapted to be held in place on said instrument by said plug.

2. The unit of claim 1 wherein said transmitter transmits at a radio frequency.

3. The unit of claim 1 wherein said transmitter is user adjustable to transmit at a frequency within the FM band.

4. The unit of claim 1 wherein said transmitter unit includes a power supply means for providing power to said circuitry.

5. The unit of claim 1 wherein said transmitter unit includes a coil of wire or other conductive means connected to said circuitry and adapted to induce a RF pattern with the strings of said stringed musical instrument, the combination of said coil or said other conductive means and said strings acting as an antenna when the unit is in use.

6. A transmitter unit for use with a stringed musical instrument having a transducer electrically connected to an output jack, said unit comprising:

a lower housing containing a lower circuit board;

a phono plug extending from said lower housing;

an upper housing detachably mounted to said lower housing, said upper housing including an upper circuit board;

said circuit board being electrically connected to said lower circuit board by connector pins power supply means;

said upper and lower circuit boards being electrically connected to said power supply means and to said phono plug to comprise said transmitter circuitry for said transmitter, an output of said circuitry leading to an antenna means.

7. The unit of claim 6 wherein said power supply means comprises at least one battery.

8. The unit of claim 6 wherein said plug comprises an upper base portion, a lower base portion and a lower plug portion, said lower plug portion being adapted for electrical connection to a portion of a jack of said stringed musical instrument that can provide a musical signal from said stringed musical instrument to said transmitter circuitry.

9. The transmitter of claim 8 wherein said upper base portion and said lower base portion are adapted for electrical connection to a portion of said jack that can provide a ground for said transmitter circuitry.

10. The unit of claim 8 wherein said upper base portion is electrically connected to said lower base portion when said plug is inserted into said jack, to electrically complete said circuitry for said transmitter.

11. The transmitter of claim 6 wherein said electrical connections between said phono plug and the remainder of said circuitry for said transmitter are made interior to said lower and upper housings.

12. The transmitter of claim 6 wherein said circuitry of said transmitter is connected to a coil of wire.

13. The transmitter of claim 12 wherein said circuitry of said transmitter comprises an appropriately adapted RF, frequency modulated, oscillator.

14. The transmitter of claim 12 wherein said circuitry of said transmitter comprises a Colpitts oscillator.

15. The unit of claim 6 wherein said upper housing is threadedly mounted to said lower housing.

16. A transmitter unit for use with a stringed musical instrument having a transducer electrically connected to an output jack, said unit comprising:

a housing containing transmitter circuitry and a coil of wire or other conductive means connected to said circuitry and adapted to induce an RF pattern with the strings of said stringed musical instrument, the combination of said coil or said other conductive means and said strings acting as an antenna when the unit is in use;

a phono plug projecting from said housing and adapted to be inserted into an output jack to provide an electrical input to said circuitry from said transducer and to connect said strings to a ground of said circuitry, said housing being adapted to be held in place on said instrument by said plugs.

17. The unit of claim 16 wherein said transmitter transmits at a user adjustable frequency within the FM band.

18. The unit of claim 17 wherein said transmitter circuitry comprises an RF oscillator.

19. The unit of claim 17 wherein said transmitter circuitry comprises a Colpitts oscillator.

20. The unit of claim 16 wherein said unit includes a power supply means contained in said housing for providing power to said circuitry.

* * * * *